United States Patent [19]

Calandritti et al.

[11] 4,341,165

[45] Jul. 27, 1982

[54] SECURITY SYSTEM INCLUDING A REVOLVING DOOR

[76] Inventors: Rosario Calandritti; Biagio Calandritti, both of Via Gorizia 92, Turin, Italy

[21] Appl. No.: 154,565

[22] Filed: May 29, 1980

[30] Foreign Application Priority Data

Jun. 11, 1979 [It] Italy ..... 68249/79

[51] Int. Cl.[3] ..... E05G 3/00

[52] U.S. Cl. ..... 109/8; 49/42

[58] Field of Search ..... 49/41, 42, 43; 109/5, 109/8, 11, 17, 57 T

[56] References Cited

U.S. PATENT DOCUMENTS

| | | | |
|---|---|---|---|
| 3,046,914 | 7/1962 | Sandberg | 109/17 X |
| 3,285,209 | 11/1966 | Pace | 49/42 X |
| 4,060,039 | 11/1977 | Lagarrigne | 109/8 X |
| 4,063,519 | 12/1977 | Pretini | 49/42 X |

*Primary Examiner*—Kenneth Downey

*Attorney, Agent, or Firm*—Sughrue, Mion, Zinn, Macpeak & Seas

[57] ABSTRACT

A security system for controlling access to a room or part of a building through an opening comprises a revolving door turnable only in a single predetermined direction of rotation about a vertical axis situated at the center of a passage defined by a pair of opposite walls each in the form of cylindrical sectors disposed at either side of the opening, and locking means for stopping the revolving door and locking it in a predetermined angular position in such a way as to lock in a person passing through the said passage if, for example, a weapons detector senses that he is armed. The security system is further provided with a curved sliding door angularly displaceable about the axis of rotation of the said revolving door between an open position adjacent one of the two passage-defining walls, and a closed position spanning the said two walls across the opening leading from the said passage into the room or part of the building into which access is controlled by the system.

6 Claims, 5 Drawing Figures

X
X
A
B
10
11a
11b
20
22
22b
24
36
46

10
12
14
16
18
22
24
26
26a
27
28
29
30
32
34
36
38
40
42
44
46

SECURITY SYSTEM INCLUDING A REVOLVING DOOR

The present invention relates in general to a security system for controlling access to a protected region, which may be a room or part of a building, accessible through an opening.

In particular, the present invention relates to an improvement in a known security system of the type comprising: two opposite fixed walls of bullet-proof material in the form of partly cylindrical panels each having a width such as to subtend an angle substantially in the region of 90° and disposed on either side of the said opening in such a way as to define a passage having an entrance opening facing outwardly of the protected region and an exit opening facing into the said protected region, a revolving door turnable only in a single predetermined rotational sense about a vertical axis located at the centre of the said passage, the revolving door comprising four panels of bullet-proof material, angularly spaced from one another by 90°, and means for stopping the rotation of the revolving door in a pre-established angular position and for locking it in this position in such a way as to lock a person attempting to pass through the door into a space between two adjacent panels of the revolving door and one of the said two partly cylindrical walls.

A security system of this above described type is known, for example, from U.S. Pat. No. 1,979,479. In this patent the locking of the revolving door is effected by means of a remote controlled electromagnetic device which operates a bolt engageable in an aperture formed in the revolving door, in such a way as to lock its movement when it reaches the said predetermined angular orientation.

A security system similar to this is illustrated in U.S. Pat. No. 3,697,972, in which the locking system for the revolving door is controlled in an automatic manner by means of a weapons detector which, when it detects the presence of a weapon carried by a person approaching the room or part of the building constituting the protected region protected by the security system, sends a pulse to the locking device which then stops the revolving door in the said pre-established angular position so that the armed person becomes imprisoned in the region between two adjacent panels of the door and the adjacent partly cylindrical fixed wall which defines one side of the opening. The pre-established angular orientation of the door is, of course, chosen so that the "cell" into which a detected armed intruder is locked is that defined by the partly cylindrical fixed wall which defines that side of the opening alongside which a person must pass to gain entrance into the room or protected part of the building.

With security systems of this type it is necessary, in order to release and subsequently capture the person carrying the weapon, to disengage the locking device to permit the rotation of the revolving door to recommence. Because the revolving door can rotate in only one directional sense, the security systems according to the prior art suffer from the disadvantage that upon restarting of the door a supposed criminal can then freely pass through the part of the opening of the passage facing into the protected region, with the obvious risks which follow from this.

The present invention seeks therefore to obviate the above-mentioned disadvantage by providing a safety system of the general type described above, but in which, following locking and subsequent unlocking of the revolving door, a person trapped in the door itself is constrained to turn back through the entrance opening of the passage without having any chance of being able to gain access to the protected region, so that capture can take place from outside the protected region without any risk to the occupants of the protected region.

According to the present invention a security system for controlling access to a protected region through an opening, comprises: two opposite fixed walls of bullet-proof material in the form of partly cylindrical panels each having a width such as to subtend an angle substantially in the region of 90° and disposed on either side of the said opening in such a way as to define a passage having an entrance opening facing outwardly of the protected region and an exit opening facing into the said protected region, a revolving door turnable only in a single predetermined rotational sense about a vertical axis located at the centre of the said passage, the revolving door comprising four panels of bullet-proof material, angularly spaced from one another by 90°, and means for stopping the rotation of the revolving door in a pre-established angular position and for locking it in this position in such a way as to lock a person attempting to pass through the door into a space between two adjacent panels of the revolving door and one of the said two partly cylindrical walls, characterised in that there are further provided auxiliary closure means including a partly cylindrical panel of bullet-proof material, of a width at least as great as the said exit opening, the panel of the said auxiliary closure means being in the form of a sliding door angularly displaceable about the axis of rotation of the revolving door between an open position in which it does not obstruct movement through the exit opening of the passage and a closed position in which it securely closes the said exit opening.

In a preferred embodiment of the invention there are provided motor means for driving the said sliding door between its open position and its closed position.

One embodiment of the present invention will now be more particularly described, by way of example, with reference to the accompanying drawings, in which.

Figure 1:
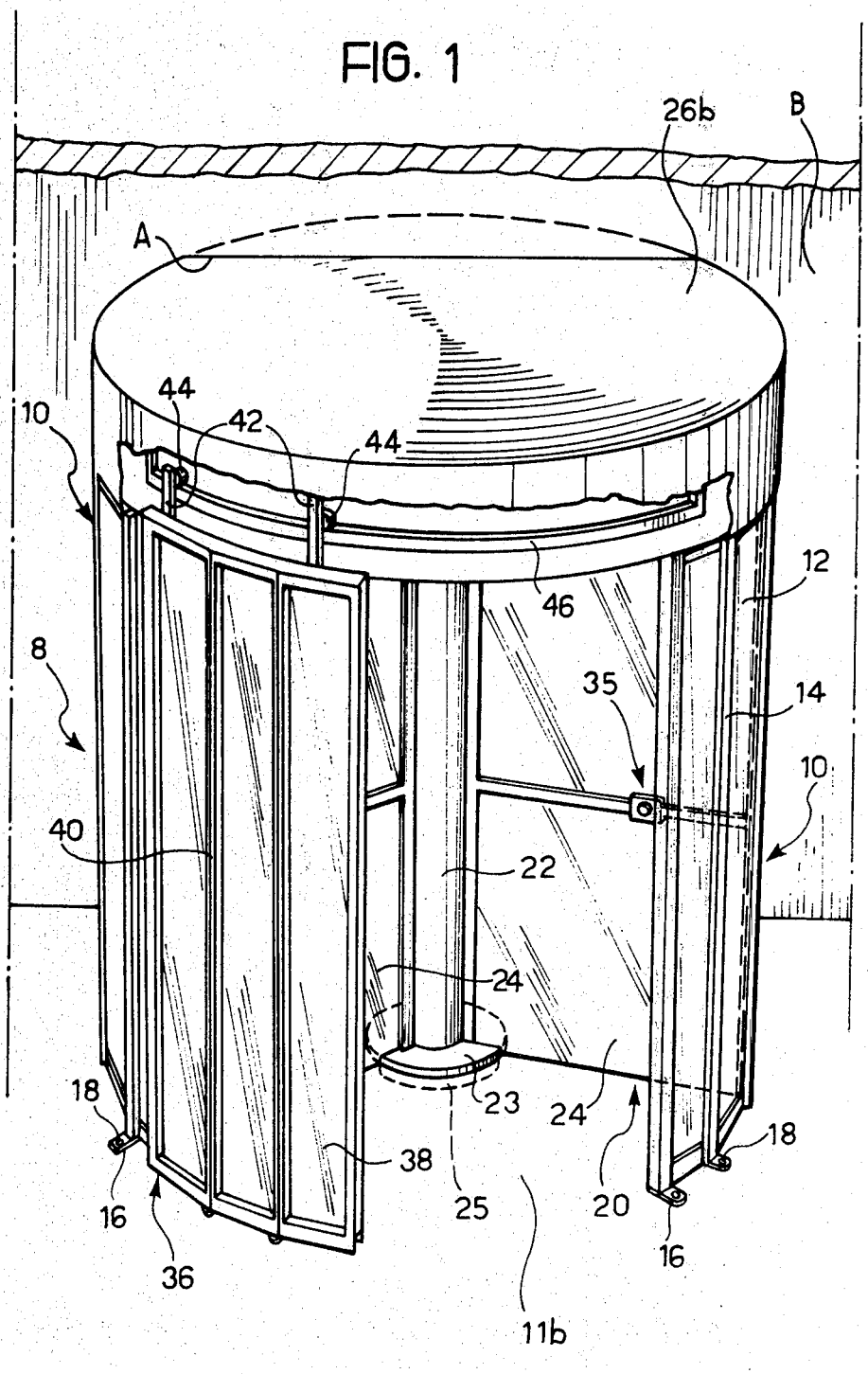
FIG. 1 is a schematic perspective view of a security system formed as one embodiment of the invention.

Referring now to the drawings, the security system illustrated therein essentially comprises a fixed structure substantially in the form of an upright, generally cylindrical, cabin structure 8 and a revolving door 20.

Figure 2:
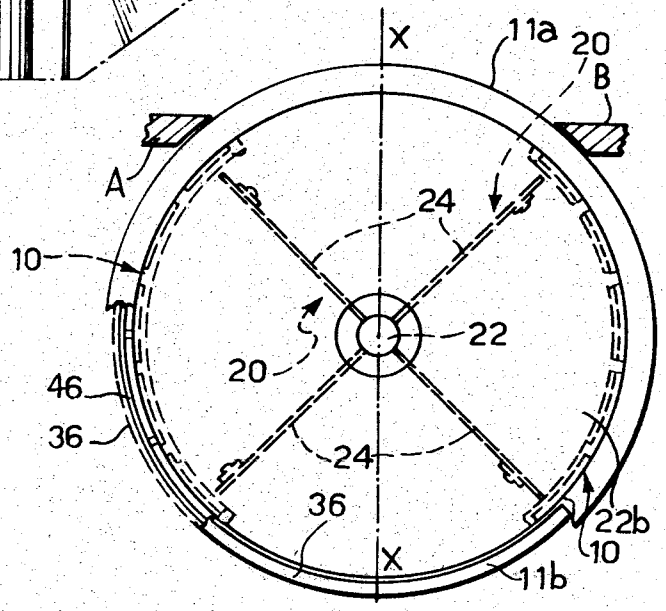
FIG. 2 is a schematic plan view of the system illustrated in FIG. 1.

The cabin structure 8 is constituted by two opposite walls 10 in the form of upright, partly cylindrical panels each having a width subtending an angle slightly greater than 90° at the centre of the cylinder. As is illustrated in FIGS. 1 and 2, the cabin structure 8 is disposed in an opening A formed in a wall which separates a region to be protected, such as, for example a bank or a transit corridor of an airport, from the outside in such a way that entrance to the protected region can only be gained through the opening A. The two upright partly cylindrical walls 10 of the cabin structure 8 are fixed to the floor in positions diametrically opposite one another across a median axis X—X of the aperture A in such a way as to define an entrance/exit passage having an entrance opening, indicated 11*a* in FIG. 2, facing outwardly from the region to be protected, and an exit opening, indicated 11*b*, facing into the protected region itself.

Each upright partly cylindrical wall 10 is made up of a plurality of flat panels 12 of transparent bullet-proof material arranged as the faces of a prism and connected along their edges by means of elongate strips 14 of suitable channel section. The strips 14 defining the lower edges of the walls 10 are provided with a plurality of attachment flanges 16 which are fixed to the floor by means of screws 18.

The revolving door 20 is centrally positioned in the cylindrical space defined by the two walls 10 and comprises a rotatable central shaft 22 having a horizontal base 23 supported by a thrust bearing 25 embedded in the floor. The central shaft 22 of the revolving door 20 carries four vertical panels of transparent bullet-proof material angularly spaced from one another by 90°, and is supported at the top in a rotatable manner by a frame structure 26 having radial arms 26*a* which are fixed to the upper sides of the fixed walls 10 and carry an annular support member 27. The arms 26*a* of the upper frame structure 26, which as can be seen in FIG. 1 can be provided with a protective covering 26*b*, also carry a support platform 28 on which there is mounted an electric motor 29. The motor 29 is connected to a non-reversing transmission 32 which is constituted, for example, by a worm screw and worm wheel arrangement the details of which are not shown. This transmission drives a pinion 34 with a vertical axis meshing with a toothed ring 30 secured, in a manner not shown, to the upper part of the revolving door 20.

Four push button switches 35 each fitted to a respective one of the panels 24 of the revolving door 20 are connected to a control circuit (not illustrated) of the motor 29 for energising this latter to turn the revolving door. In this way the rotation of the door 20 can be effected without requiring any significant manual force to be applied to the door by the user.

A sliding door generally indicated 36, in the form of a partly cylindrical panel the width of which is substantially equal to, or slightly greater than, that of the exit opening 11*b* between the two opposite fixed walls 10 of the cabin structure 8 is suspended from the top of the cabin structure 8. The sliding door 36 is constituted, like the walls 10 of the cabin structure 8, by a plurality of flat panels 38 of bullet-proof transparent material arranged as the faces of a prism and connected by means of shaped strips 40 of suitable channel section. The sliding door 36 is provided at the top with two attachment projections 42 each of which carries a rotatable roller 44 movable along a curved track 46. The track 46 has a length substantially equal to twice the width of the sliding door 36 and is supported by the annular support structure 25 in a position extending above the exit opening 11*b* and along the upper part of one of the walls 10 of the cabin structure 8.

Figures 3, 5:
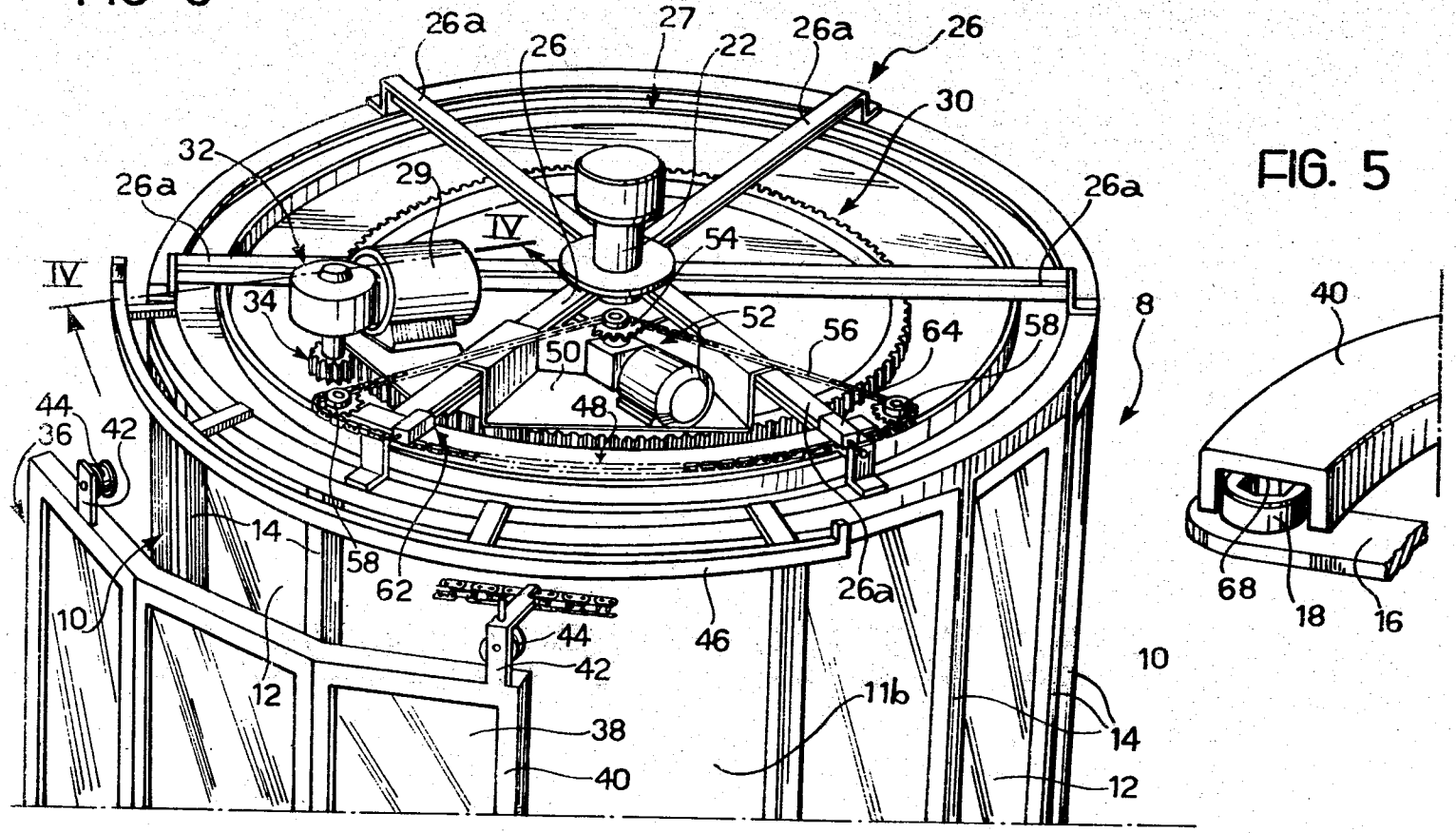
FIG. 3 is a partially exploded perspective view on an enlarged scale, of the upper part of the system illustrated in FIG. 1.
FIG. 5 is a perspective view, on a further enlarged scale, of a detail of the system illustrated in FIGS. 1 to 4.

A curved guide element 48 is supported by the arms 26*a* of the frame structure 26 located in a position adjacent the track 46. Two of the arms 26*a* carry a fixed support platform 50, on which is mounted a motor/gearbox unit 52 which rotatably drives a toothed sprocket 54 having a vertical axis. The toothed sprocket 54 engages a closed loop of chain 56 which also passes over two end-of-loop sprockets 58. In the branch of the chain between the sprockets 58, the chain 56 is guided along the curved guide element 48 and is connected to one of the attachment projections 42 of the sliding door 36 as shown in FIG. 3. At each end of the curved guide element 48 there is arranged a respective end-of-travel switch 62,64, each of which is connected in an electrical control circuit, not illustrated in the drawings, connected to the motor/gearbox unit 52. By means of the arrangement described above, the sliding door 36 is displaceable angularly about the axis of the central shaft 22 of the revolving door 20 between an open position, illustrated in FIG. 1 and in solid outline in FIG. 2, and a closed position illustrated in broken lines in FIG. 2, in which it obstructs the exit opening 11*b*. The end-of-travel switches 62,64 are operated by the projections 42 by means of which the sliding door 36 is connected to the chain 56, in such a way as to stop the displacement of the sliding door 36 when this reaches the end of its movement, respectively the open position or the closed position.

Figure 4:
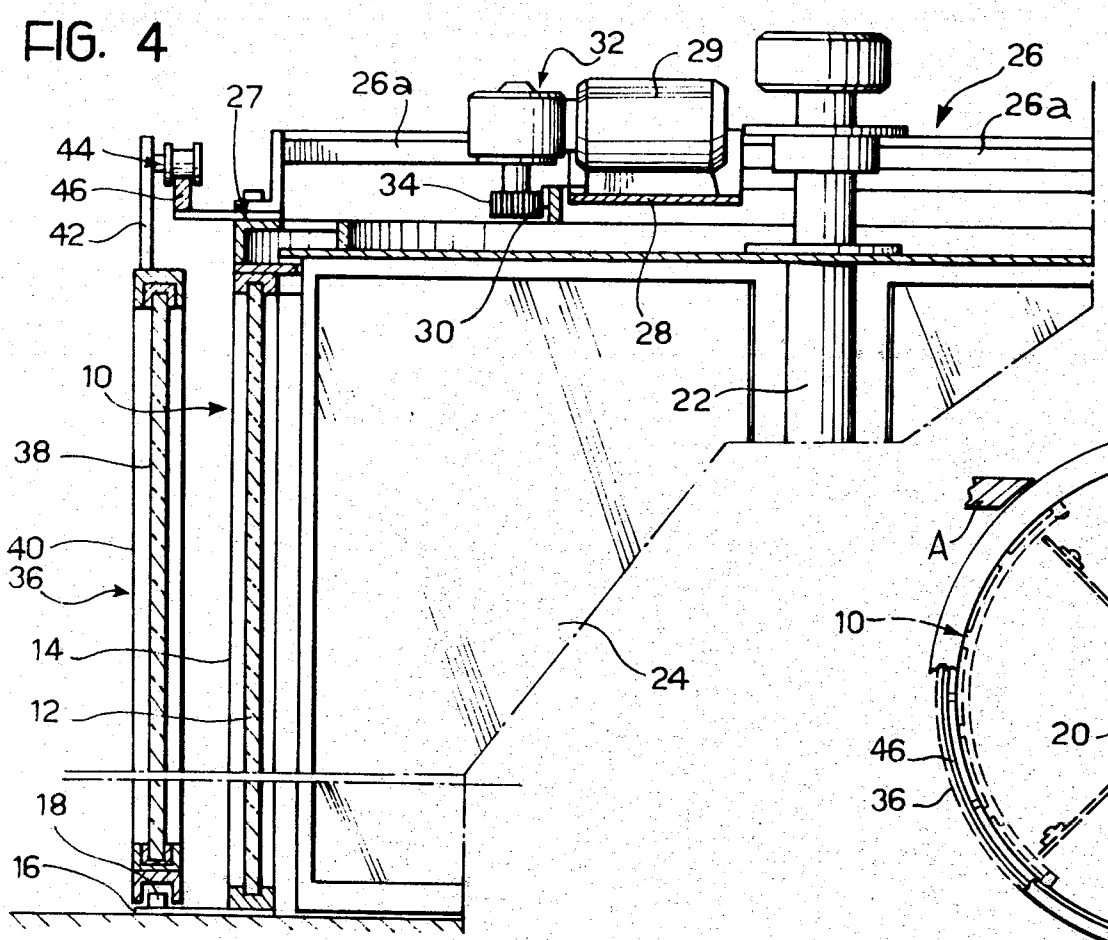
FIG. 4 is a partial section, on an enlarged scale, taken on the line IV—IV of FIG. 3.

As can be seen in greater detail in FIG. 4 and FIG. 5, the bottom strip 40 of the sliding door 36 is provided with a downwardly facing longitudinal groove 68 which slides over the heads of the screws 18 which fix the walls 10 to the floor, so that these screws correctly guide the displacement of the bottom edge of the door 36 itself and hold it securely against being forced outwardly.

The security system of the invention is further provided with a weapons detector device, not illustrated in the drawings, which can be fixed to one of the walls 10 at or adjacent the entrance opening 11*a*, or else can be arranged to cover an access doorway which has to be traversed in advance of the entrance opening 11*a*. This weapons detector, which can be, for example, of the type described and illustrated in U.S. Pat. No. 3,697,972, is electrically connected to a locking device (not illustrated in the drawings) intended to be activated when the detector senses the presence of a weapon carried by a person who is about to gain access to the interior of the protected region through the revolving door 20 of the security system. Because, as has been previously mentioned, the rotation of the revolving door 20 is controlled by means of the motor 29 through the non-reversible transmission system 32, this locking device can advantageously by constituted simply by suitable switching means for stopping the motor 29 when the revolving door 20 is in a predetermined orientation.

The activation of the motor/gearbox unit 52 to control the displacement of the sliding door 36 may either be effected by means of a remote control system operated automatically or manually from within the protected region, or alternatively the displacement of the sliding door 36 from its open position to its closed position may be automatically controlled, by means of an electrical switch, (not illustrated), which is tripped by the weapons detector or by the locking device of the revolving door 20.

The operation of the safety system according to the invention is as follows:

In normal conditions the sliding door 36 is in its open position and any person intending to enter the protected region, after having entered the cabin 8 through the entrance opening 11*a*, requires only to press one of the push button switches 35 carried by the panels 24 in order to cause activation of the electric motor 29. The electric motor 29 drives the revolving door 20 through an angular distance of 180° whereby to carry the user to the exit opening 11*b* through which he can pass into the interior of the protected region without it being necessary to apply any manual pushing force onto the panels 24 of the revolving door 20. Indeed, the revolving door may have a floor which turns with the door so that the user does not even have to walk between the entrance opening 11*a* and the exit opening 11*b*.

In the event that the weapons detector with which the system is provided senses the presence of a weapon carried by the individual who has entered the cabin structure 8 through the entrance opening 11*a*, a pulse is sent from the detector to the locking device so that the electric motor 29 is stopped in a position such as to lock the rotation of the revolving door 20 after an angular displacement of 90°. Thanks to the non-reversible nature of the worm screw/helical gear transmission system 32 the revolving door 20 is locked securely in this angular position, whereupon the armed individual remains imprisoned between the two adjacent panels 24 of the revolving door 20 and that fixed wall 20 of the cabin structure 8 against which these panels pass when moving towards the exit opening 11*b* with reference to the rotational direction of the revolving door 20.

Comtemporaneously, or subsequently, the motor/-gearbox unit 52 is energised in a manner such as to displace the sliding door 36 from its open position to its closed position in which latter it closes the exit opening 11*b* from the cabin structure, facing into the protected region. After this the electric motor 29 may be restarted at any time to control the revolving door to rotate through 270° in such a way as to carry the armed individual right back to the entrance opening 11*a* without there being any risk of the armed individual gaining access to the interior of the protected region through the exit opening 11*b*. In this way the armed individual can be captured from outside the protected region without any risk to the occupants of the protected region itself. The presence of the upper structure 26 and of the cover 26*b* of the cabin 8 effectively prevents any attempt by the individual trapped in the device to escape out through the top of the cabin structure 8.

What is claimed is:

1. In a security system for controlling access to a protected region through an opening, of the type comprising:

two opposite fixed walls of bullet-proof material, both in the form of partly cylindrical panels having a width such as to subtend an angle substantially in the region of 90°, said fixed walls being disposed on either side of said opening in such a way as to define between them a passage having an entrance opening facing outwardly of said protected region and an exit opening facing into said protected region, a revolving door turnable only in a single predetermined rotational sense about a vertical axis, said revolving door being located at the centre of said passage, said revolving door comprising four panels of bullet-proof material, angularly spaced from one another by 90°, and means for stopping the rotation of said revolving door with said door in a pre-established angular position and for locking it in this position whereby when said stopping and locking means are energised a person attempting to pass through said passage is trapped in a space between two adjacent panels of said revolving door and one of said two partly cylindrical walls, the improvement wherein:

there are further provided auxiliary closure means, including a partly cylindrical panel of bullet-proof material, having a width at least as great as that of said exit opening, said panel of said auxiliary closure means being in the form of a sliding door angularly displaceable about said axis of rotation of said revolving door between an open position in which it does not obstruct said exit opening of said passage and a closure position in which it securely closes said exit opening, an upper support structure fixed to the upper ends of said fixed partly cylindrical walls;

a curved track carried by said upper support structure, the length of said curved track being at least twice that of the width of said sliding door, said curved track being located so as to extend over said exit opening and part of one of said partly cylindrical fixed walls;

suspension means including rollers for suspending said sliding door from said track, a curved guide element carried by said upper support structure, a closed loop of chain guided by said curved guide element, means attaching an intermediate point of said closed loop of chain to said sliding door, and a motor unit carried in said upper support structure for driving said closed loop of chain and consequently said sliding door.

2. The security system of claim 1, further comprising motor means for driving said sliding door between its said open position and its said closed position.

3. The security system of claim 1, wherein said upper support structure has a covering panel supported thereby.

4. The security system of claim 2, wherein said support structure further supports a non-reversible motor/-transmission unit for effecting rotation of said revolving door, push button control means being provided on each of said panels of said revolving door, operation of said push button control means controlling said motor/-transmission unit to operate to turn said revolving door through a rotation of 180°.

5. The security system of claim 4, wherein said motor/transmission unit includes a motor, a toothed pinion turnable about a vertical axis, a non-reversible transmission unit comprising a worm screw and a helical gear wheel interconnecting said motor and said toothed pinion, and a toothed ring gear meshing with said toothed pinion being fixed coaxially to the upper part of said revolving door.

6. The security system of claim 4 further including a weapons detector, and wherein said motor/transmission unit includes means for stopping it in a position such that said revolving door is in said pre-established angular position, following receipt of a signal from said weapons detector.

* * * * *